United States Patent [19]

Kurtin

[11] 4,088,799

[45] May 9, 1978

[54] METHOD OF PRODUCING AN ELECTRICAL RESISTANCE DEVICE

[75] Inventor: Stephen L. Kurtin, Chatsworth, Calif.

[73] Assignee: Hughes Aircraft Company, Culver City, Calif.

[21] Appl. No.: 438,898

[22] Filed: Feb. 1, 1974

Related U.S. Application Data

[63] Continuation-in-part of Ser. No. 111,897, Feb. 2, 1971, abandoned.

[51] Int. Cl.[2] ..... B05D 3/06; H01C 13/00; C23C 17/00

[52] U.S. Cl. ..... 427/38; 338/310; 427/82; 427/85; 427/88; 427/102; 427/108; 427/123; 427/124; 427/125; 427/259; 427/265; 427/266; 428/203; 428/208; 428/209; 428/210; 148/1.5; 148/33.3; 252/500; 252/512; 252/514; 428/433; 428/434

[58] Field of Search ..... 117/201, 93.3; 148/1.5; 252/500, 518; 338/310; 427/38

[56] References Cited

U.S. PATENT DOCUMENTS

| | | | |
|---|---|---|---|
| 2,950,996 | 8/1960 | Place et al. | 117/227 |
| 3,390,012 | 6/1968 | Huberecht | 117/212 |
| 3,481,776 | 12/1969 | Manchester | 148/1.5 |
| 3,523,042 | 8/1970 | Bower | 148/188 |
| 3,562,022 | 2/1971 | Shifrin | 117/93.3 |
| 3,600,797 | 8/1971 | Bower | 148/1.5 |
| 3,718,502 | 2/1973 | Gibbons | 117/213 |

*Primary Examiner*—John T. Goolkasian
*Attorney, Agent, or Firm*—Allen A. Dicke, Jr.; W. H. MacAllister

[57] ABSTRACT

The process by which this device is made comprises the implantation of ions into an insulator. Surface charge on the insulator is discharged during implantation by an electron beam or by a thin conductive surface layer previously deposited on the insulator. Ion energy and dose are selected to embed ions into the insulating lattice to a sufficiently high local concentration to produce a zone of lower resistance which is the implanted zone. The dosage which presently appears to be a minimum dosage for providing a conductive zone in the insulative body is the order of $10^{18}$ ions per square centimeter. Beam currents upward from 10 microampers per centimeter square implanted areas are satisfactory.

3 Claims, 5 Drawing Figures

METHOD OF PRODUCING AN ELECTRICAL RESISTANCE DEVICE

CROSS REFERENCE

This application is a continuation-in-part of patent application Ser. No. 111,897, filed Feb. 2, 1971, now abandoned.

BACKGROUND OF THE INVENTION

This invention relates generally to a method for producing solid-state insulators, and more specifically to ion implanted insulators.

As used throughout this specification, the term "insulator" refers to a non-metallic solid state material with an apparent resistivity in excess of $10^9$ ohm-centimeter at room temperature. Prior efforts at creating electrically conductive regions within insulators have been ineffectual because of the difficulty inherent in "doping" an insulator. The prior efforts have been principally directed at doping by diffusion. Doping is usually understood to be the addition of a subtle (less than 1 in $10^3$) amount of impurity atoms to a solid to grossly change its electrical properties, while leaving other properties essentially unaltered. The purpose of diffusing dopants into an insulator is to produce impurity centers which can contribute charge carriers to the conduction process. However, this approach is seldom successful. Insulators are not, in general, amenable to being produced in a state of high purity, and hence a large background concentration of impurities is often present. In addition, the charge associated with impurities is often localized on the impurity site and, hence, cannot contribute to conduction. Amorphous insulators are an even more complex situation; large numbers of defect centers and unsatisfied bonds act to render a conventional doping approach unfeasible.

Ion implantation is the introduction of atoms into the surface layer of a solid substrated by bombardment of the solid with ions in the KeV to MeV energy range. The solid-state aspects are particularly broad because of the range of physical properties that are sensitive to the presence of a trace amount of foreign atoms. Mechanical, electrical, optical, magnetic, and superconducting properties are all affected and indeed may even be dominated by the presence of such foreign atoms. Use of implantation techniques affords the possibility of introducing a wide range of atomic species, thus making it possible to obtain impurity concentrations and distributions of particular interest; in many cases, these distributions would not be otherwise attainable. Recent interest in ion implantation has focused on the study of dopant behavior in implanted semiconductors and has been stimulated by the possibilities of fabricating novel device structures in this way. This is the common definition in the art. Implantation is within about the top 200 angstroms nearest the surface. A book which gives an overview of the implantation art as it relates to semiconductors is ION IMPLANTATION IN SEMICONDUCTORS, by James W. Mayer et al, 1970, Academic Press, New York, the entire disclosure of which is incorporated herein by this reference.

The inventive technique propounded herein, in contradistinction to the conventional doping approach, is to implant a massive local concentration of metallic ions in the insulator. Conduction occurs by the interaction of these implanted ions, either directly or in conjunction with the electronic environment provided by the host insulator.

SUMMARY OF THE INVENTION

In order to aid in the understanding of this invention, it can be stated in essentially summary form that it is directed to the method for making a new composition of matter which comprises metallic ions implanted into an insulator material to a sufficient extent to provide electrical conductivity within the implanted volume.

Accordingly, it is an object of this invention to produce a new composition of material which comprises metallic ions implanted in an insulator material, to a sufficient extent to provide electrical conductivity in the implanted volume. It is a further object to provide a method by which such is accomplished.

It is a further object to have a process for producing the new composition of matter, comprising the steps of directing a metallic ion beam at an insulative substrate or body with sufficient energy to implant the ions within the insulator material and implanting sufficient ions to modify a region within the insulator structure so that it becomes electrically conductive.

It is another object to discharge surface charge by applying a metallic film to the area to be implanted, so that surface charging masks the adjacent areas to ccomplish surface charge masking of areas where implantation is unwanted.

Another object of this invention is to provide a method of producing a region within an insulator which will behave ohmically. Still a further object of the present invention is to provide various elecrical devices incorporating the use of a conduction region within and as an integral part of an insulator. Yet another object of this invention is to provide a thermistor having a conduction region within an insulating substrate.

It is a further object to provide a resistor which can be tailored to a specific fairly high value of sheet resistance and can be tailored to specific temperature coefficients by control of implantation variables.

Other objects and advantages of this invention will become apparent from a study of the following portion of the specification, the claims, and the attached drawings.

DESCRIPTION OF THE PREFERRED EMBODIMENT

Figure 1:
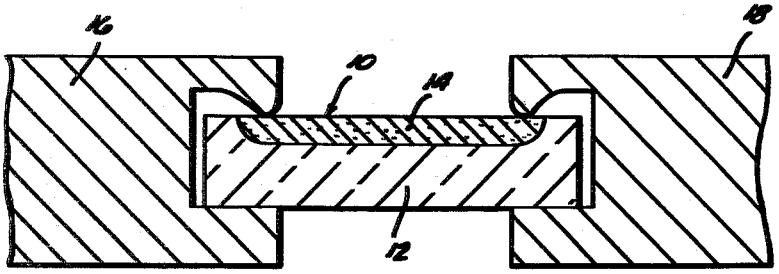
FIG. 1 is a schematic sectional view normal to the surface of an implanted insulative substrate, showing electrical connection.

FIG. 1 illustrates a new electronically conductive resistor device 10. It comprises an insulator substrate or body 12 into which is implanted a volume or region 14 (drawing not to scale) of metal ions. The ions are implanted into a region within the insulator substrate to a density within a few orders of magnitude of the density of the host atoms of the insulator substrate, thereby creating a conduction region within the insulator.

In view of the fact that the resistor device is of electrical significance, electrical connections 16 and 18 are made to the device with contact being made at spaced locations of the implanted region. Thus, electric current passing from connector 16 to connector 18 passes through the implanted region. In view of the fact that the balance of the device, that is, the insulator substrate which is not implanted, is electrically insulative in character, all current flows through the implanted region.

The original base material which has been implanted to create an electrically resistive region is a solid state insulator, which class includes glass, sapphire, and alumina. It is noted that these materials are respectively viscous liquid, monocrystalline and amorphous, thus demonstrating the wide scope of insulator material which can be successfully implanted to provide a resistor device. Other insulators which are believed to be implantable to produce a resistor include metallic oxides, such as $SiO_2$ and $CoO_2$; metallic nitrides, such as AlN; metallic carbides, such as SiC, and the like.

Figure 2:
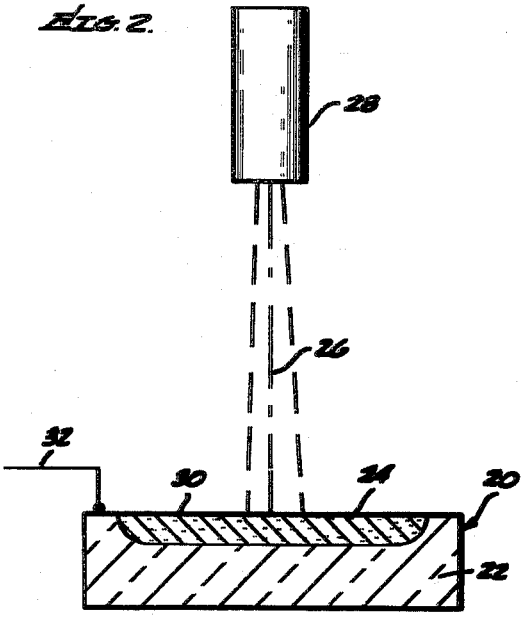
FIG. 2 schematically illustrates the process of implanting the device, with charge being drained off by means of a conductive top surface layer.

FIG. 2 illustrates a resistor device 20, which is similar to resistor device 10. It has an insulator body 22 and an implanted zone 24. FIG. 2 shows implantation in progress. At the start, region 24 does not exist. Implantation is accomplished by metallic ion beam 26 being directed at the top surface of body 22 to implant ions into the body to produce the implanted zone 24. Conventional ion source 28 provides the ion beam. The beam can be scanned over the zone 24, or can be of sufficient size to implant the whole zone 24 at one time. A mask can be employed to control the outline of the implanted area. In order to prevent a positive electrical surface charge buildup due to ion beam inpaction upon the top of body 22, the top of body 22 is coated with a thin layer 30 of electrically conductive material. As described below, the layer 30 can pattern the lateral outlines of the implanted region, instead of using a mask. One of the purposes of layer 30 is to drain off any surface charge and for this purpose, it is connected by line 32 to ground, or other location for this purpose. The starting thickness of useful metal layers was found to be approximately from 50 to 150 angstroms.

In order for implantation to be effective, the metal layer 30 must be sufficiently thin that something is driven into the substrate. That which is driven in is both the incoming ion beam and atoms from the layer 30 of electrically conductive material. In addition, the incoming ion beam causes sputtering of the surface. The presence of a metal film affects the sputtering rate and, since the ion dose is large, the ratio of ions arriving in the beam to the ions lost by sputtering is important. Normally, the metal layer 30 is sufficiently thin that at least part of the incoming ion beam passes therethrough and is implanted into the insulative substrate, part of the later is sputtered away, and part of the thin filmlayer is driven into the insulative substrate. As the implantation proceeds, the metal layer 30 may be completely sputtered away and driven in, so that no identifiable layer continues to exist. In this case, the conductivity of the implanted region must be sufficient to dissipate the surface charging affect, if implantation is to continue.

As a result, there is a tradeoff between sputtering and implantation. As long as the metal film continues to exist, it participates in the implantation and in the sputtering.

Finally, when the metal film is sputtered away, equilibrium between implantation and substrate sputtering occurs. This equilibrium is dependent upon the energy of the incoming ions and the sputtering rate of the insulative material body 22 upon which the incoming ions impinge. The ions penetrate only a short distance, on the order of tens to hundres of angstroms. Maximum concentration is achieved in a localized region, as an equilibrium is reached between the number of incoming ions and the sputtering rate. Typically peak concentrations of $10^{22}$ ions /$cm^3$ are feasible. Therefore, the minimum total number of ions which must be delivered to the insulator surface to achieve saturation concentration is on the order of 100 to 1,000 monolayers (i.e., $10^{18}$ ions per square centimeter).

With respect to patterning of the area which is implanted, surface charging by the incoming ion beam causes reflection of ions, except where the surface charge is drained away. As described above, this is accomplished by the placement of a metal film. Since implantation thus occurs only in the area where the metal film occurs and is appropriately grounded to prevent surface charging, the surface charge results in a masking effect. By this means, the area to be implanted can be designed and its lateral outline shaped by placing the charge removal metal film where implantation is desired. Surface charging masking is fully effective to laterally shape the implanted areas. After the metal film is sputtered away, there is an implanted region therebelow which is sufficiently conductive that implantation continues to occur only in those areas which had been positioned under the metal film.

Figure 3:
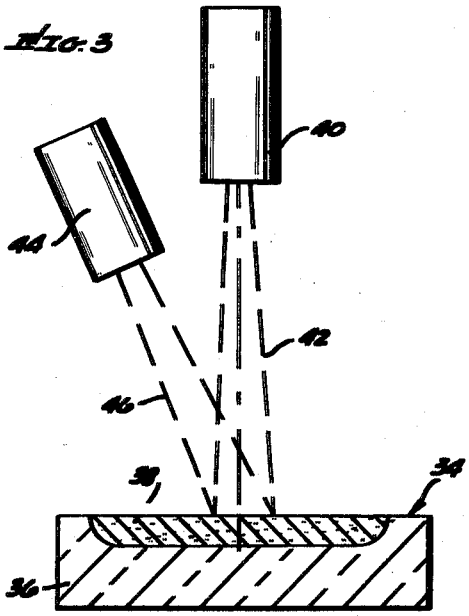
FIG. 3 is a schematic illustration of the process for implanting the device employing an electron beam to neutralize the surface charge.

FIG. 3 illustrates a device 34 which is identical to the device 10. It is also identical to the device 20, except for the layer 30. Device 34 has an insulator body 36 and an implanted zone 38. In this case, ion source 40 produces a beam 42 of metal ions for impaction upon and implantation into body 36 to produce the implanted zone 38. Again, beam 42 can be of sufficient size to cover the entire implanted zone 38, or can be scanned for that purpose. A separate physical mask having an opening of the wanted outline can be employed to control the lateral outline shape of the implanted area. In FIG. 3, electron beam source 44 directs an electron beam 46 onto the surface of body 36 to neutralize the surface charging effect of the ion beam 42. By this means, surface charge buildup is prevented.

Certain minimum and maximum beam conditions and dosages are believed to be critical for proper implantation to accomplish a composition which results in useful electrical resistivity, as contrasted to insulator character. The examples below outline the process conditions and characteristics of the finished devices.

EXAMPLE I

A glass microscope slide, of ordinary soft glass, was cleaned and vacuum-coated with a layer of gold about 100 angstroms thick. The coated slide was placed in the implantation apparatus, and the coating was connected to apparatus ground to drain off the surface charge which otherwise would result from the implantation beam. A mask was placed over the coated slide, to expose a sample area of about 1 centimeter square.

An ion beam was directed at the unmasked area. This ion beam was of antimony ions. The average beam current was 10 microamperes and beam voltage was 10 keV. Implantation continued for 90 minutes. An ion equivalent to about 1,000 monolayers was delivered to the surface, about $10^{18}$ ions per square centimeter. This is considered the minimum dosage.

A semi-transparent blue-gray region was formed in the glass slide adjacent to the surface. Electrical contact was made to the edges of the blue-gray region by vapor deposition of a metallic film. Sheet resistance of this region was $3.7 \times 10^7$ ohms per square, as compared to the resistance of the basic glass slide of about $10^{12}$ ohms per square. During the implantation, the gold film was very nearly all sputtered away or driven into the glass so that it did not substantially affect the sheet resistance. The treatment of the implanted body with aqua regia to dissolve away any remaining gold layer showed no substantial change in resistive behavior. This also indicates that the implanted material is indeed implanted into the glass, as the implanted area did not appear to be any more affected by the aqua than the unimplanted area of the glass slide. Tests showed that both antimony and gold were implanted.

EXAMPLE II

Example I was substantially repeated employing an aluminum coating on a glass sample, and implanting with a 10 keV antimony ion beam at a current of 50 microamperes for 110 minutes. This formed a grey region within the glass. Resistivity of the region was 147 ohms per square at room temperature and 106 ohms per square at 77° K. The sample was etched for 1 minute in ammonium hydroxide and the resistance thereupon increased to $1.75 \times 10^3$ ohms per square at room temperature.

EXAMPLE III

A monocrystalline sapphire substrate was prepared and coated with an antimony film having an optical density of about 0.6. This antimony coating was connected to equipment ground, and a suitable mask was put in position. An antimony ion beam with an energy of 10 keV and a current of 50 microamperes was directed at the 1 centimeter square implant area. Implantation continued for 90 minutes. The total number of implanted ions was determined by neutron activation analysis to be about $2.0 \times 10^{15}$ per square centimeter. Mean ion range is calculated to be about 80 angstroms. Since sapphire contains $2.5 \times 10^{22}$ alumina structural units per cubic centimeter, the implanted region contained at least 1 antimony atom for every 10 alumina units. After attachment of connectors, sheet resistivity was determined to be $2 \times 10^9$ ohms per square at room temperature, this is point 50 in FIG. 4. The implanted area was chemically inert, electrically conductive and optically visible (optical density at 600 nm $\approx$ 0.24).

EXAMPLE IV

Example III was repeated using the same ion beam directed at a sapphire substrate bearing a somewhat thinner Sb film and implanting for 70 minutes. This resulted in a total number of implanted antimony ions of $7.0 \times 10^{15}$ per sq. cm. The sheet of resistivity of the implanted region was $3 \times 10^7$ ohms per square at room temperature, as seen at point 52 in FIG. 4.

EXAMPLE V

Example IV was repeated using a 15 keV antimony ion beam having a 10 microampere current, for 90 minutes. This resulted in $1.3 \times 10^{16}$ implanted ions per sq. cm. and a sheet resistivity of $3 \times 10^3$ ohms per square, see point 54. The number of implanted ions in Example III through V was determined by neutron activation analysis.

EXAMPLE VI

Amorphous alumina ($Al_2O_3$) was employed as a body, and treated the same as the monocrystalline sapphire body of Example V. It was implanted with an antimony beam of 30 microamps current and 13 keV energy for a time of 120 minutes. A test of the sheet resistivity at room temperature showed the implant to have a sheet resistance of about $10^6$ ohms per square, as compared to a value of $10^{12}$ ohms per square for the unimplanted body.

Figure 4:
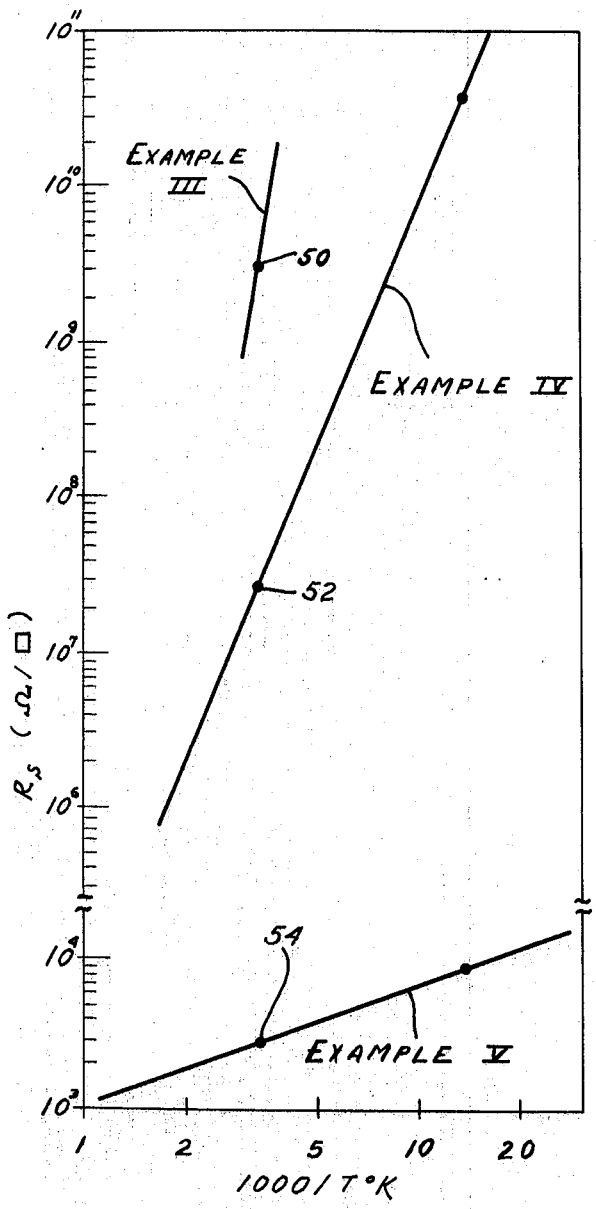
FIG. 4 is a semi logarithmic graph of sheet resistance versus temperature for several devices.

FIG. 4 illustrates that with different implantation conditions different temperature coefficients are achieved.

Figure 5:
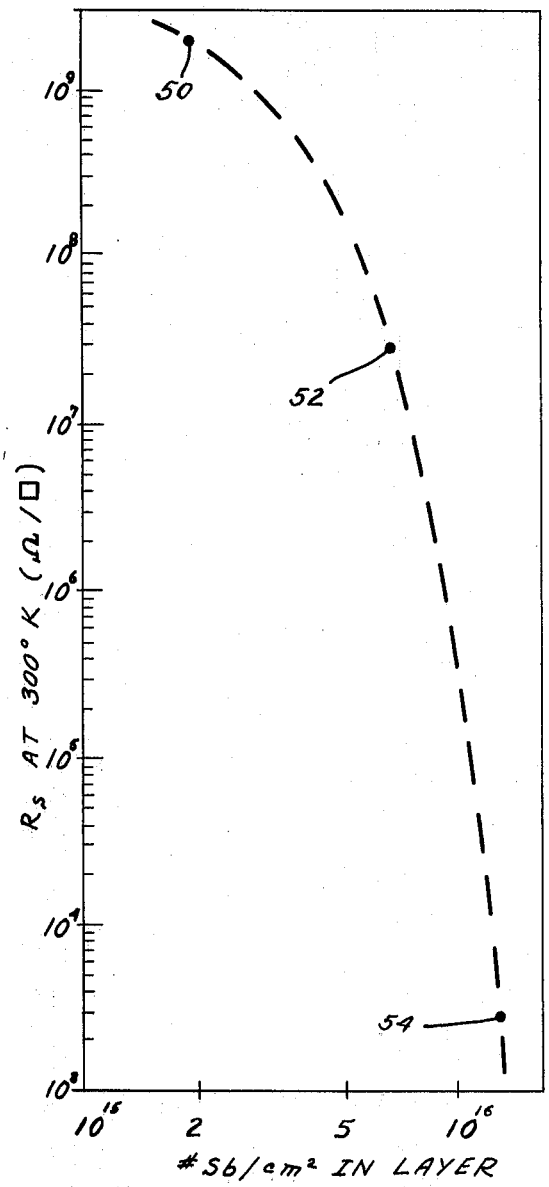
FIG. 5 is a semi logarithmic graph of sheet resistace versus number of implanted ions in a device.

FIG. 5 illustrates that with different implantation conditions that a wide range of sheet resistances are possible. With the devices of Examples III, IV and V the sheet resistance ranges over six orders of magnitude.

Body materials of electrically resistive character which are suitable for implantation are glass, alumina, sapphire, quartz, refractory oxides, etc. Choice of the body is more a function of the mechanical use to which it will be put, and the environment in which it will be employed than a limitation on the technique. Different kinds of insulator bodies into which implantation can be achieved, for the creation of a local resistive path, include semiconductor integrated circuits wherein an insulative metal oxide is employed for surface protection or insulative character. Such devices include metal oxide semiconductor devices wherein the semiconductor material is silicon. In such structures, a local resistive path can be implanted into the metal oxide layer for electrical purposes with respect to the remainder of the circuit. In the case of silicon on sapphire semiconductor structures, resistive electrical paths can be implanted into the sapphire substrate adjacent the doped silicon electrically-active zone, or even therebeneath, so that it can contribute as part of the integrated circuit.

The coating material to discharge the implantation current can be gold, antimony, aluminum, copper, silver, etc., or combinations of layers, such as gold plus antimony. The thickness of the coating depends to a certain extent upon the ion beam current, the density of the coating material, and the relationship of the coating material to the metal ions in the implanting beam. Film thicknesses from 50 to 150 angstroms are suitable. If the film is not completely sputtered away during implantation, if desired, the remainder can be removed before use by etching.

The metal ion to be implanted to form the implanted strata and to provide a conductive path include Ag, Au, Sb, Al, Cu, Ga, Fn, Ca, Sn, Te, Na, Li, K, Cs, B, Bi, Th, Pt, and In. Antimony is illustrated in most of the above examples, because of limitations of the particular ion beam source. With a suitable ion beam source, any one of the above-listed metallic ions can be employed and implanted. Convenient beam sources can easily implant any of the following ions: Ag, Au, Sb, Al, Cu, and Ca. Several successful experiments were conducted using gallium ion beams directed at sapphire substrates with electron beam neutralization.

Ion implantation into a resistive material is, as discussed here, a brute force technique. It is possible to imbed ions into the insulating lattice to a very high local concentration. Peak concentrations of $10^{22}$ ions per cubic centimeter are feasible. This provides an implanted region on the order of 100 angstroms thick in which the chemical composition differs markedly from that of the remainder of the body. To accomplish such implantation energy, it appears that a minimum beam current of 10 microamperes and a minimum acceleration potential of 10 keV is required. Furthermore, a maximum required beam energy is 40 keV. No successful implants were achieved at beam energies above this value, perhaps because of excessive sputtering. Beam currents of up to 50 microamperes per square centimeter are practical.

In general, the result of such implantation is an implanted resistor, whose mechanical properties are very similar to those of the substrate. It was noted that, in many cases, the resistance of such resisitors varied with temperature. It is novel with this process to be able to select slope of the R v. T curve by means of controllable implantation parameters, as illustrated in FIG. 4. Further a wide range of sheet resistance values is provided by selection of implantation parameters. FIG. 5 illustrates a range of six orders of magnitude. In the stated examples, the resistance indicated are room temperature values.

This invention having been described in its preferred embodiment, it is clear that is susceptible to numerous modifications and embodiments, including variations in substrate, implantation ion beam and energy of implantation within the ability of those skilled in the art and without the exercise of the inventive faculty.

What is claimed is:

1. The process of producing an electrical resistance device having a selected thermal coefficient of resistance comprising the steps of:

bombarding at selected implantation parameters an inorganic electrical insulator body having an initial resistance of at least $10^9$ ohm centimeters with a stream of metal ions with sufficient energy to implant at least some of the ions beneath the surface of the insulator body, for a sufficient length of time to implant at least $10^{15}$ ions per square centimeter to reduce the electrical resistance of the implanted portion of the insulator body to below $10^{10}$ ohms per square;

simultaneously discharging the ion current from the surface of the body where the ion stream impinges upon the body by coating a substantially ion permeable electrically conductive coating on the surface of the body upon which the ion beam impinges, and electrically connecting the conductive coating to discharge the ion current; and terminating bombardment when the total number of implanted selected metal ions per unit area substantially reaches a selected value corresponding to a selected thermal coefficient of resistance as a result of the selected implantation parameters.

2. The process of producing an electrical resistance device having a selected thermal coefficient of resistance comprising the steps of:

bombarding at selected implantation parameters an inorganic electrical insulator body having an initial resistance of at least $10^9$ ohm centimeters with a stream of metal ions with sufficient energy to implant at least some of the ions beneath the surface of the insulator body, for a sufficient length of time to implant at least $10^{15}$ ions per square centimeter to reduce the electrical resistance of the implanted portion of the insulator body to below $10^{10}$ ohms per square;

simultaneously discharging the ion current from the surface of the body where the ion stream impinges upon the body by coating a substantially ion permeable electrically conductive coating on the surface of the body upon which the ion beam impinges with the coating laterally shaped in accordance with the desired outline shape of the implanted zone so that the uncoated surface of the body obtains a surface charge from the incoming ion beam and hence surface charge masking permits implantation only through the coated portion of the body by electrically connecting the conductive coating to discharge the ion current; and terminating bombardment when the total number of implanted selected metal ions per unit area substantially reaches a selected value corresponding to a selected thermal coefficient of resistance as a result of the selected implantation parameters.

3. The process of producing an electrical resistance device having a selected thermal coefficient of resistance comprising the steps of:

bombarding at selected implantation parameters an inorganic electrical insulator body having an initial resistance at least $10^9$ ohm centimeters with a stream of metal ions with sufficient energy to implant at least some of the ions beneath the surface of the insulator body, for a sufficient length of time to implant at least $10^{15}$ ions per square centimeter to reduce the electrical resistance in the implanted portion of the insulator body to below $10^{10}$ ohms per square;

simultaneously discharging the ion current from the surface of the body where the ion stream impinges upon the body by directing an electron beam at the surface of the body on which the ion beam impinges, the electron current being substantially at least as large as the ion current; and terminating bombardment when the total number of implanted selected metal ions per unit area substantially reaches a selected value corresponding to a selected thermal coefficient of resistance as a result of the selected implantation parameters.

* * * * *